US005954369A

United States Patent [19]

Seabrook

[11] Patent Number: 5,954,369

[45] Date of Patent: Sep. 21, 1999

[54] GREETING CARD WITH KIT FOR HEALTH TESTING

[76] Inventor: March E Seabrook, 2036 Shady La., Columbia, S.C. 29206

[21] Appl. No.: 09/083,924

[22] Filed: May 22, 1998

Related U.S. Application Data

[60] Provisional application No. 60/059,535, Sep. 19, 1997.

[51] Int. Cl.[6] ..... B42D 15/02; B42D 15/04

[52] U.S. Cl. ..... 283/117; 40/124.1; 206/308.1; 283/117

[58] Field of Search ..... 40/124.1; 283/117; 206/308.1

[56] References Cited

U.S. PATENT DOCUMENTS 3,987,900 10/1976 Tadokoro et al. ..... 206/308.3
4,365,970 12/1982 Lawrence et al. ..... 436/66
4,870,764 10/1989 Boone ..... 40/124.1

*Primary Examiner*—Willmon Fridie, Jr.
*Assistant Examiner*—Mark T. Henderson
*Attorney, Agent, or Firm*—Michael A Mann; Nexsen Pruet Jacobs & Pollard LLP

[57] ABSTRACT

A greeting card is formed to have a pocket for receiving a test kit therein. In one embodiment of the present invention, the greeting card is a fiftieth birthday greeting card and the test kit is a fecal occult blood test kit. The pocket is formed to have a cutout portion for facilitating removal of the kit, and the text and graphics of the greeting card refer to and correspond to the type of kit contained in the pocket. In the example given, competent health authorities recommend use of fecal occult blood test kits annually beginning at age fifty.

13 Claims, 2 Drawing Sheets

22
22
24
14
28
26
20
10
16
12
Happy
18
Birthday!

GREETING CARD WITH KIT FOR HEALTH TESTING

This application claims the benefit of U.S. Provisional Application No. 60/059,535, filed Sep. 19, 1997.

FIELD OF THE INVENTION

The present invention relates to greeting cards and to health. In particular, the present invention relates to birthday cards that contain kits for testing one aspect of a person's health.

BACKGROUND OF THE INVENTION

As people age, it is known that they become more susceptible to illness and disease, particularly cancer and heart disease. A prudent individual will recognize that fact and take the necessary steps to make certain that illnesses and diseases are avoided if possible by adopting a proper diet, by exercising, and by avoiding lifestyle habits that contribute to poor health. Inevitably, taking the proper steps does not always avoid illness and disease. Early detection can make treatment easier, more successful and less expensive if and when disease or illness occur. Furthermore, as the population ages and medical expenses continue to increase, early detection of illness becomes a primary means of controlling the costs of health care.

The usual way illness and disease is detected is with a physical examination by a doctor. The scope of the examination will vary depending on, for example, the patient's age, gender, family history and overall condition. Some examinations are specific to particular diseases, especially to cancer and heart disease.

A cancer-related checkup is recommended by the American Cancer Society every three years for people between the ages of twenty and forty, and every year for those over forty. This type of checkup can include health counseling and a physical examination of the thyroid, oral cavity, skin, lymph nodes, testes, prostate gland, and ovaries, as well as examining for other non-malignant diseases.

There are special tests that are recommended by the American Cancer Society and other health organizations for some types of cancers. Some recommendations cover a wide spectrum of the population. For example, an annual examination for oral cancer is recommended for everyone; and examinations for skin cancer should be done every three years for those ages twenty to forty and annually thereafter.

Certain types of cancer are gender specific. Clinical physical examinations are recommended every three years for women between the ages of twenty and forty; above forty years of age, clinical examinations are recommended every year. Also, for women over forty, annual mammograms are recommended. Annual Pap tests and pelvic exams are recommended for women who are sexually active or over the age of eighteen. After three or more consecutive, satisfactory examinations, less frequent examinations are appropriate at the discretion of the physician. Endometrial biopsies are recommended for women at menopause and for women at high risk, such as those with a history of infertility, obesity, failure to ovulate, or who have abnormal uterine bleeding or who have had unopposed estrogen or tamoxifen therapy.

For men, both prostate-specific antigen testing and a digital rectal examination should be offered annually, beginning at age fifty, to men who have at least a ten-year life expectancy, and to younger men who are at higher risk because of familial predisposition or who are African Americans.

Still other recommendations are directed to both men and women who are older, namely fifty years of age or older.

In particular, one avoidable type of cancer is colorectal cancer. Beginning at age fifty, average risk men and women should have a yearly digital rectal examination and fecal occult blood test. Every three to five years, a flexible sigmoidoscopy is warranted. Individuals at increased risk include those with (1) a personal history of colorectal cancer or adenomatous polyps; (2) a family history in a first degree relative younger than sixty or in two first degree relatives of any age, or (3) a personal history of chronic inflammatory bowel disease, or (4) a family history of colorectal cancer syndromes such as familial adenomatous polyposis and hereditary non-polyposis colon cancer. Those individuals should have more intensive screening and surveillance for colorectal cancer. The incidence of colorectal cancer can be greatly reduced if these guidelines are followed.

Birthday greetings are generally lighthearted. For the very young, they celebrate growing up; for older adults, they may carry messages that tease the recipient about growing old. Although most birthday greetings are simply cards carrying graphics and text, others have "pop up" designs or contain small electronic devices that produce sounds. Birthday greeting cards are used primarily for their entertainment value.

Cards can carry information, however, including health information, perhaps in an entertaining greeting card format. See, for example, the patent issued to Lieberman, U.S. Pat. No. 4,991,877, for greeting-card-style drug information cards.

Cards can also carry useful forms. Wolf, in U.S. Pat. No. 5,219,184, teaches a gift card that includes its own thank you note. Greeting cards that contain test kits are, however, not known.

SUMMARY OF THE INVENTION

According to its major aspects and broadly stated, the present invention is a greeting card, and in particular, a birthday card containing a kit that enables the recipient to perform at least a part of a health test. As such the card and kit are useful in encouraging the recipient of the card to undergo a health checkup. In one preferred embodiment, the kit is a fecal occult blood test kit inserted in a pocket formed in a fiftieth birthday card. In alternative embodiments, the kit may be one or more cards containing information for the recipient about suitable checkups that are appropriate for that individual's age.

Greeting cards are articles of manufacture that are made of pasteboard or card stock, which is paper that is heavier or thicker than stationary, and that carry text and graphics directed to an event, either a holiday or an occasion specific to the recipient. There are greeting cards for Christmas, Yom Kippur, New Years Day, Valentine's Day, birthdays, Father's Day, Mother's Day, graduations, etc.

Test kits may be devices for use in taking samples of body fluids or tissues or surveys or questionnaires that are designed to obtain information from someone that is useful in determining risk of illness or disease.

The present invention is the combination of a greeting card and a test kit, preferably a card having a pocket formed therein, and where the text carried by the card refers to the kit. Most preferably, the pocket has a cutout portion that facilitates removal of the kit, and the kit and the event are related. Preferably, the relationship is one involving health and age where generally recognized authorities, such as the American Cancer Society, recommend that certain activities commence when one reaches a particular age. The primary example of the present invention is a fecal occult blood test kit in a fiftieth birthday card, because annual testing for colorectal cancer using such a kit is recommended to begin at age fifty in the average risk population.

A feature of the present invention is the use of a birthday greeting, for example, a fiftieth birthday greeting, to carry a test kit related to health, such as a fecal occult blood test kit for colorectal cancer detection. The advantage of this feature is that what might otherwise be a grim reminder of some of the negative aspects of aging can be made more acceptable by the lighter nature of a birthday card. Birthday cards are also given by those who are emotionally connected to the recipient. Therefore, these same individuals would also be inclined to show concern for the recipient's health and well being.

Another feature of the present invention is that providing a fecal occult blood test kit to an individual, for example, can be made more acceptable when it is included in a birthday greeting card. Birthday greeting cards for older adults are known to treat aging in a humorous manner. Therefore, the kit is more readily accepted in this form.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 1:
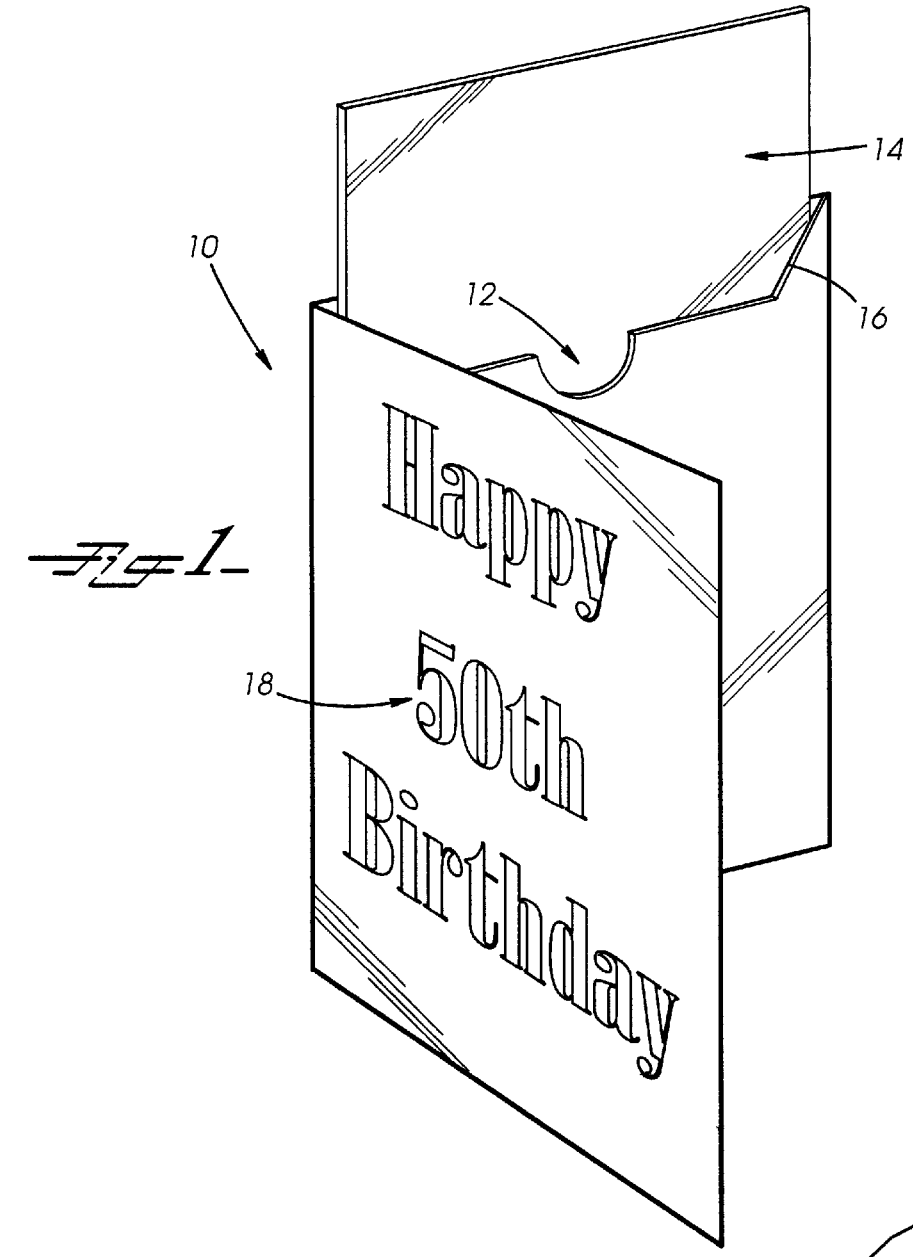
FIG. 1 is a perspective, partially exploded view of a birthday card according to a preferred embodiment of the present invention.
Figure 2:
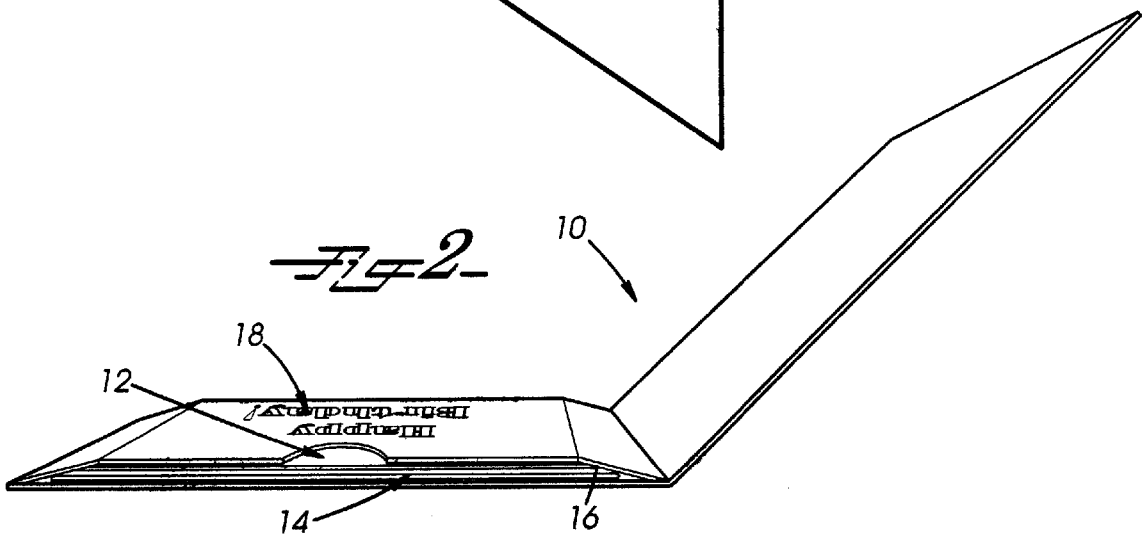
FIG. 2 is a top view of the card of FIG. 1.
Figure 3:
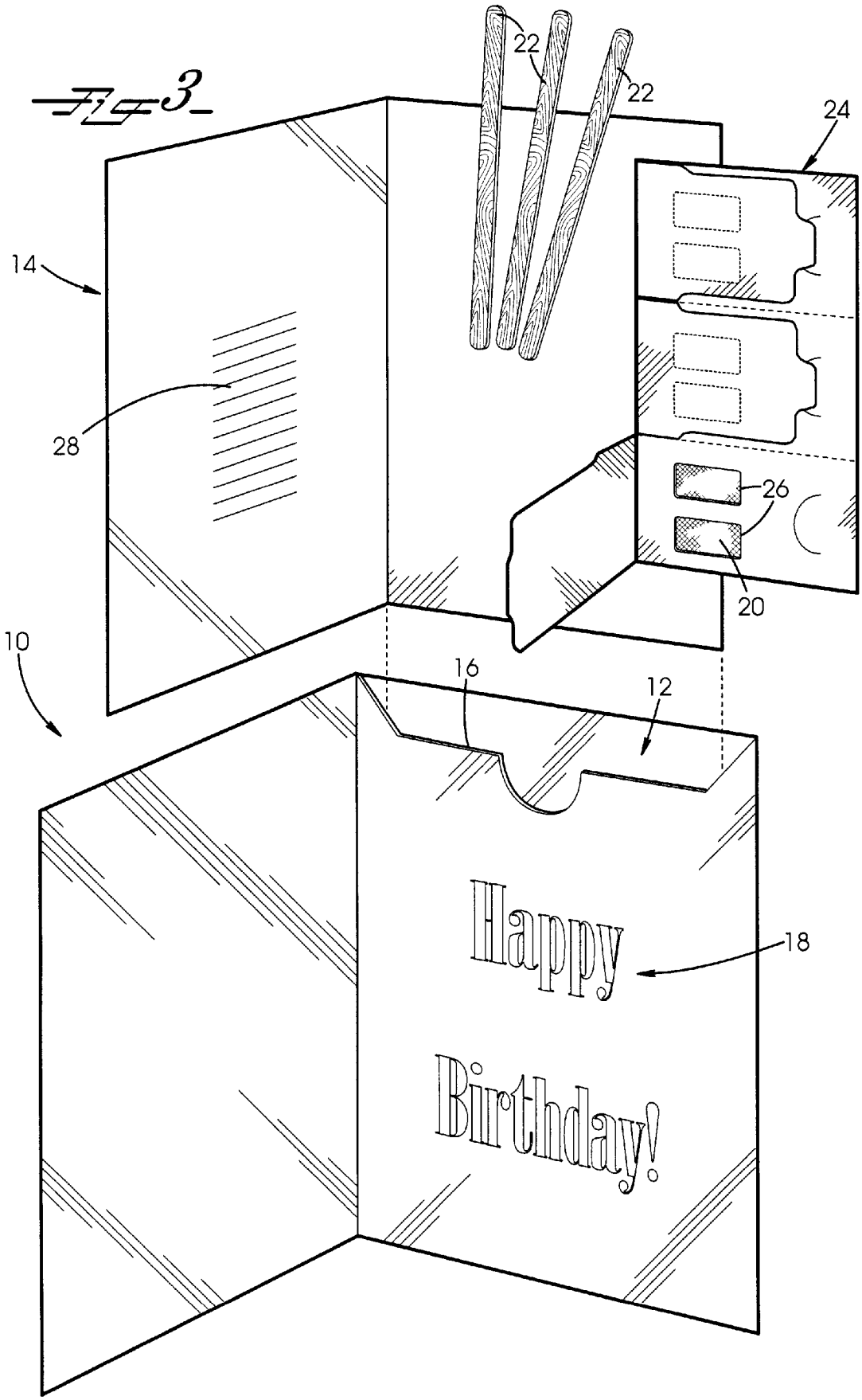
FIG. 3 is a perspective, fully exploded view of a card containing a colorectal test kit, according to another preferred embodiment of the present invention.

Referring now to FIGS. 1–3, there is illustrated a birthday card with a pocket. The pocket contains a fecal occult blood test kit, or "stool kit."

Greeting card 10 is an otherwise standard card except that it has a pocket 12 formed in it for a test kit 14. Pocket 12 preferably has a cutout portion 16 to facilitate removal of kit 14. Card 10 is made of card stock or pasteboard and carries text and graphics, collectively referred to by reference number 18. Text 18 refers to kit 14 and the purpose of providing it with a birthday greeting. In this embodiment, test kit 14 is preferably provided with a fiftieth birthday greeting card because the American Cancer Society recommends annual testing with such kits begin at age fifty. Therefore, card 10 would refer to the enclosed kit 14 and what it is used for and associate that with the fact that the recipient was about to turn fifty years of age, and that use of kit 14 was now appropriate and a part of turning fifty.

A fecal occult blood test kit 14 comprises a cellulosic pad 20, several disposable wooden sticks 22, and a pasteboard envelope 24 that has several windows 26 formed in it to provide access to cellulosic pad 20 attached to the inside of the envelope 24. Instructions 28 are printed on the pasteboard envelope 24. Using sticks 22 that are housed in envelope 24, the user is instructed to smear small samples of his feces onto cellulosic pad 20 at each window 26. Then kit 14 is analyzed at a laboratory. If the results are positive, further testing to determine the source of the positive results is warranted.

The present invention is, of course, not limited to fiftieth birthday greeting cards or to colorectal cancer or to fecal occult blood test kits. For example, a greeting card for wishing a happy new year could also contain information on an inserted card about alcohol consumption. A birthday card could contain printed information or computer readable, programmed diskettes or compact diskettes carrying information about heart disease, including a test in the form of a questionnaire designed to increase awareness of risk factors for heart disease.

Test kits for personal use should not supplant testing and examination by trained medical personnel. However, as microprocessor technology and algorithms for testing various body fluids and tissues become more sophisticated, test kits for personal use will become easier to use and more reliable as indicators of the presence or absence of conditions related to health.

Birthday cards, especially fortieth and fiftieth birthday cards, are particularly suitable for the present invention, because recommendations by competent health authorities are keyed to those particular ages. The text of the card preferably corresponds to the kit by referring to the kit in the pocket and connecting the occasion with the need for the test that the kit, at least in part, facilitates. Birthday cards can be sent to individuals who are turning forty or fifty by their employers who may provide health insurance for them, by health and life insurance companies, by their doctors, and by kit manufacturers, as well as by their friends and relatives.

It will be apparent to those skilled in the art that many changes and substitutions can be made to the preferred embodiment herein described without departing from the spirit and scope of the present invention as defined by the appended claim.

What is claimed is:

1. An article of manufacture comprising:

an occasion greeting card with a pocket formed therein and a cutout portion formed in said pocket, said greeting card containing text and graphics;

a kit carried within said pocket, said pocket dimensioned to receive said kit, said kit carrying health information, said text and said graphics corresponding to said occasion, said kit being a diskette programmed with information about a disease and a questionnaire regarding susceptibility to said disease.

2. The article as recited in claim 1, wherein said kit is a device for collecting samples of body fluids for testing.

3. The article as recited in claim 1, wherein said kit contains a cellulosic pad, plural wooden sticks, a pasteboard envelope containing said cellulosic pad and having windows formed therein, said pasteboard envelope housing said wooden sticks and containing instructions for use.

4. The article as recited in claim 3, wherein said greeting card is a fiftieth birthday greeting card.

5. An article of manufacture comprising:

an occasion greeting card with a pocket formed therein and a cutout portion formed in said pocket, said greeting card containing text and graphics;

a kit carried within said pocket, said pocket dimensioned to receive said kit, said kit carrying health information, said text and said graphics corresponding to said occasion, said kit being a device for collecting samples of body fluids for testing.

6. The article as recited in claim 5, wherein said kit contains a cellulosic pad, plural wooden sticks, a pasteboard envelope containing said cellulosic pad and having windows formed therein, said pasteboard envelope housing said wooden sticks and containing instructions for use.

7. The article as recited in claim 5, wherein said greeting card is a fiftieth birthday greeting card.

8. An article of manufacture comprising:

an occasion greeting card with a pocket formed therein and a cutout portion formed in said pocket, said greeting card containing text and graphics;

a kit carried within said pocket, said pocket dimensioned to receive said kit, said kit carrying health information, said text and said graphics corresponding to said occasion, said kit containing a cellulosic pad, plural wooden sticks, a pasteboard envelope containing said cellulosic pad and having windows formed therein, said pasteboard envelope housing said wooden sticks and containing instructions for use.

9. The article as recited in claim 8, wherein said greeting card is a fiftieth birthday greeting card.

10. The article as recited in claim 2, wherein said kit contains a cellulosic pad, plural wooden sticks, a pasteboard envelope containing said cellulosic pad and having windows formed therein, said pasteboard envelope housing said wooden sticks and containing instructions for use.

11. The article as recited in claim 2, wherein said greeting card is a fiftieth birthday greeting card.

12. The article as recited in claim 3, wherein said greeting card is a fiftieth birthday greeting card.

13. The article as recited in claim 6, wherein said greeting card is a fiftieth birthday greeting card.

* * * * *